US006674033B1

(12) United States Patent
Wang

(10) Patent No.: US 6,674,033 B1
(45) **Date of Patent: *Jan. 6, 2004**

(54) PRESS BUTTON TYPE SAFETY SWITCH

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/224,644

(22) Filed: Aug. 21, 2002

(51) Int. Cl.[7] ..... H01H 3/42; H01H 71/16

(52) U.S. Cl. ..... 200/334; 200/520; 200/524; 337/36; 337/56; 337/66

(58) Field of Search ..... 200/520–525, 200/529–535, 334; 337/36, 56, 62, 66, 85, 113

(56) References Cited

U.S. PATENT DOCUMENTS 3,551,867 A * 12/1970 Ingwersen ..... 337/63
5,532,444 A * 7/1996 Bonrath et al. ..... 200/524
6,335,500 B1 * 1/2002 Chi et al. ..... 200/341
6,417,756 B1 * 7/2002 Yu ..... 337/66
6,483,416 B2 * 11/2002 Yu ..... 337/126
6,504,122 B2 * 1/2003 Yu ..... 200/524

* cited by examiner

*Primary Examiner*—Michael Friedhofer
(74) *Attorney, Agent, or Firm*—Rosenberg, Klein & Lee

(57) ABSTRACT

A press button type safety switch is constructed to include a switching mechanism for switching the circuit between on/off positions, a spring-supported press button, a push member pivoted to the spring-supported press button and controlled by the spring-supported press button to slide along two symmetrical sliding tracks and to switch the switching mechanism between on/off positions, and a retaining structure provided between the switching mechanism and the push member and adapted to hold the press button in "on" position when the switch switched on and to release the press button when the switching mechanism tripped off upon an overcurrent.

10 Claims, 15 Drawing Sheets

PRESS BUTTON TYPE SAFETY SWITCH

BACKGROUND OF THE INVENTION

1. Field of the Invention

The present invention relates to electric switches and, more particularly, to a press button type safety switch, which automatically trips off upon an overcurrent and, which enables the user to determine the on/off status from the outer appearance.

2. Description of the Related Art

A variety of electric switches, including seesaw switches and press button switches are known. In early days, a press button switch has only ON→OFF function, and cannot trip off automatically upon an overcurrent. In order to eliminate this problem, a variety of safety switches are developed. Regular safety switches are commonly of seesaw switching type.

FIGS. 1A and 1B show a seesaw switch 1 invented by the present inventor. This design of seesaw switch 1 uses a plank 11 to move a conducting plate 12 between on/off positions. When an overcurrent occurred, the conducting plate 12 automatically trips.

FIGS. 2A and 2B show a press button type safety switch according to Taiwan Patent No. 422404. This structure of press button type safety switch is comprised of a housing 21, a press button 22, and an actuating block 23. The press button 22 is connected to the actuating block 23. The actuating block 23 has a heart-like positioning groove 24 in the right sidewall. The right-sided terminal 25 has a top end connected with a bimetal 26. The bimetal 26 has a top free end terminating in a retaining portion 261 adapted to engage the heart-like retaining groove 24. When an overcurrent occurred, heat is transmitted from the right-sided terminal 25 to the bimetal 26, thereby causing the bimetal 26 to deform and to disengage the retaining portion 261 from the heat-like positioning groove 24, and at the same time the press button 22 is pushed upwards by the main spring 27 to the off position. This design is not practical in use. When the contacts 291 and 292 of the movable conducting block 29 contacted the contact 251 of the right-sided terminal 25 and the contact 281 of the intermediate terminal 28, the load of current is at the terminals 25 and 28 and the movable conducting block 29 but not directly produced at the bimetal 26. When heat produced upon an overcurrent, it is transferred from the movable conducting block 29 to the right-sided terminal 25 and then transferred from the right-sided terminal 25 to the bimetal 26. Therefore, the bimetal 26 does not trip off immediately upon an overcurrent.

FIGS. 3A~3E show an overload protective press button switch according to Taiwan patent publication no. 458362. This structure of overload protective press button switch comprises a housing 31, the housing 31 having a top opening 311 and two open chambers 313 and 314 separated by a partition plate 312, a metal contact unit 33 installed in the housing 31, a switching mechanism 35, a press button assembly 32, and a linkage 34. The linkage 34 comprises a spring member 342 supported on the partition plate 312, a press member 341 mounted on the spring member 342, and a swivel holder 344 pivoted to the housing 31. The swivel holder 344 has a guide hole 343, which receives the press member 341, and a positioning portion 345 connected to the switching mechanism 35.

When pressed the press button assembly 32, the press member 341 is forced downwards to compress the spring member 342 and to bias the swivel holder 344, thereby causing the switching mechanism 35 to switch on the metal contact unit 33. When switched on, the spring member 342 pushes the press member 341 back to the initial position. The upper part I of this overload protective press button switch is similar to the design of the aforesaid prior art press button switch. The lower part II of this overload protective press button switch is similar to the design of the aforesaid prior art seesaw switch. This design is similar to Yu's Taiwan utility model no. 83365 (equivalent to U.S. Pat. No. 5,262,748) with the exception of the additional press button assembly 32. The swivel holder 344 is equivalent to Yu's seesaw plank. This structure of overload protective press button switch is complicated, resulting in high manufacturing cost and inconvenience of use. When the push button assembly 32 pressed to the position shown in FIG. 3C, and the swivel holder 344 is biased leftwards, the metal contact unit 33 is switched on. When the user released the hand from the push button assembly 32, the push button assembly 32 is moved to the position shown in FIG. 3D. Viewing from the outside, it shows no difference between the position of 3B and the opposition of 3D, therefore the user cannot know "on" or "off" status of the switch when viewed from the outside. For on/off indication, a complicated indicator circuit must be installed.

SUMMARY OF THE INVENTION

The present invention has been accomplished under the circumstances in view. It is one object of the present invention to provide a press button type safety switch, which enables the user to know "on" or "off" status of the switch from the outer appearance of the switch. It is another object of the present invention to provide a press button type safety switch, which automatically trips off upon an overcurrent. It is still another object of the present invention to provide a press button type safety switch, which is simple and inexpensive to manufacture. To achieve these and other objects of the present invention, the press button type safety switch comprises a housing, the housing having a top opening, spring means mounted inside the housing, at least two terminals mounted in the housing for connecting to power source, a switching mechanism, a press button mounted in the top opening of the housing and supported on the spring means for pressing by hand; and an actuating structure controlled by the press button to switch the switching mechanism between on/off positions. The actuating structure comprises two sliding tracks respectively formed of a plurality of sliding rails and arranged in parallel, and a push member pivoted to the press button at a bottom side and forming with the press button a linkage. The push member comprises two bottom push portions respectively supported on the switching mechanism for synchronous movement with the push member to move the switching mechanism between on/off position, two guide rods extended from two opposite lateral sides thereof and respectively slidably coupled to the sliding tracks for guiding movement of the push member to switch the switching mechanism between on/off positions, and a stop device provided on the inside above the bottom push portions. The switching mechanism comprises a plank disposed in contact with the bottom push portions of the push member adapted for switching the terminals between on/off positions, an overcurrent protective conducting plate adapted to automatically trip off the circuit of the terminals upon an overcurrent, and a stop device upwardly extended from the plank and adapted to hook up with the stop device of the push member when the switching mechanism switched on. The plank is linked to the overcurrent protective conducting plate, and forcible by the overcurrent protective conducting plate to change the tilting angle and to disengage the stop device from the stop device of the push member for enabling the press button to be pushed upwards by the spring means when the overcurrent protective conducting plate tripped off upon an overcurrent.

BRIEF DESCRIPTION OF THE DRAWINGS

FIG. 6 is similar to FIG. 5 but showing the press button type safety switch switched on.

DETAILED DESCRIPTION OF THE PREFERRED EMBODIMENT

Figure 1A:
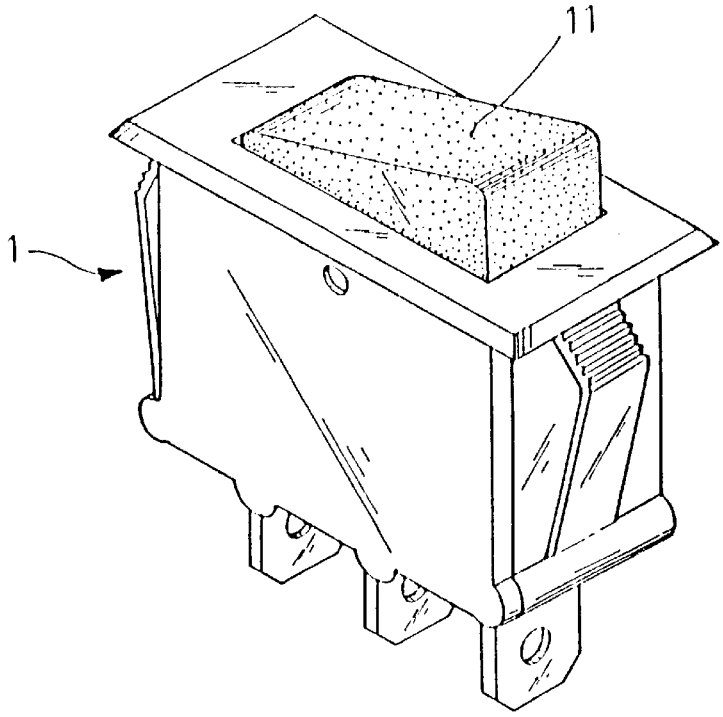
FIG.1(A) PRIOR ART
FIG. 1A is an elevational view of a seesaw switch according to the prior art.
Figure 1B:
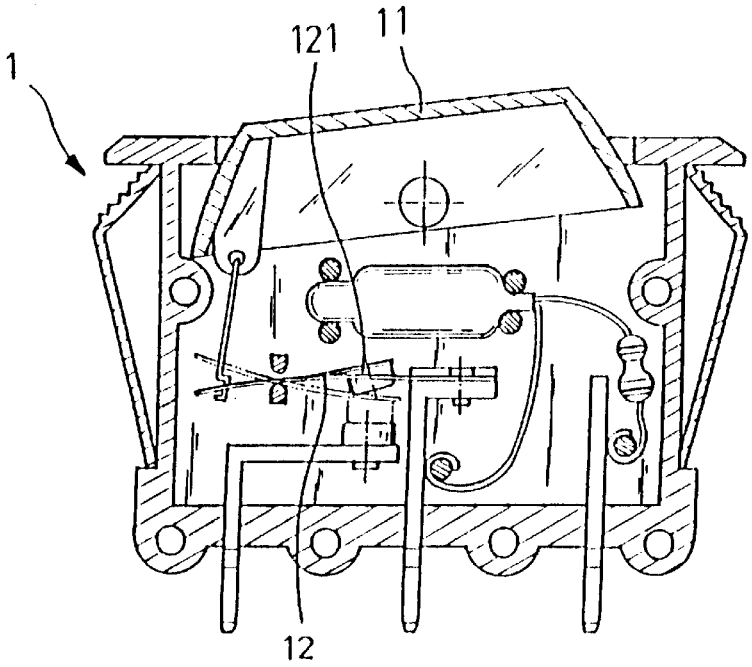
FIG.1(B) PRIOR ART
FIG. 1B is a sectional view of the seesaw switch shown in FIG. 1A.
Figure 2A:
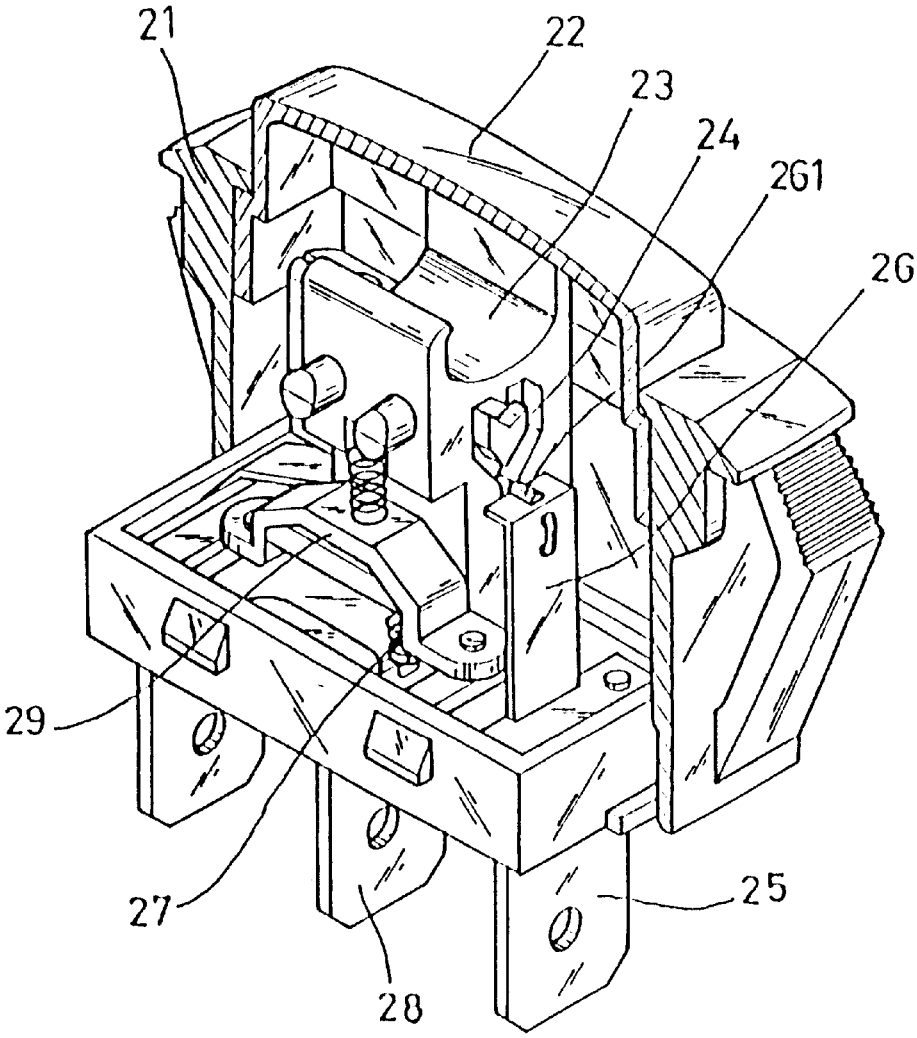
FIG. 2(A) PRIOR ART
FIG. 2A is a cutaway view of a press button type safety switch according to the prior art.
Figure 2B:
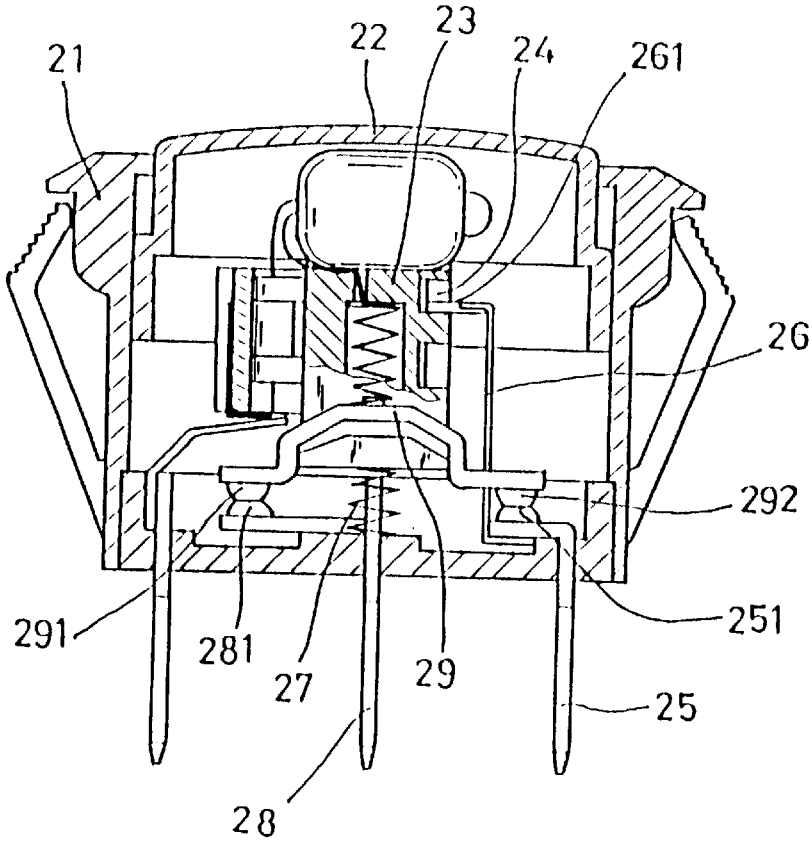
FIG. 2(B) PRIOR ART
FIG. 2B is a sectional view of the press button type safety switch shown in FIG. 2A.
Figure 3:
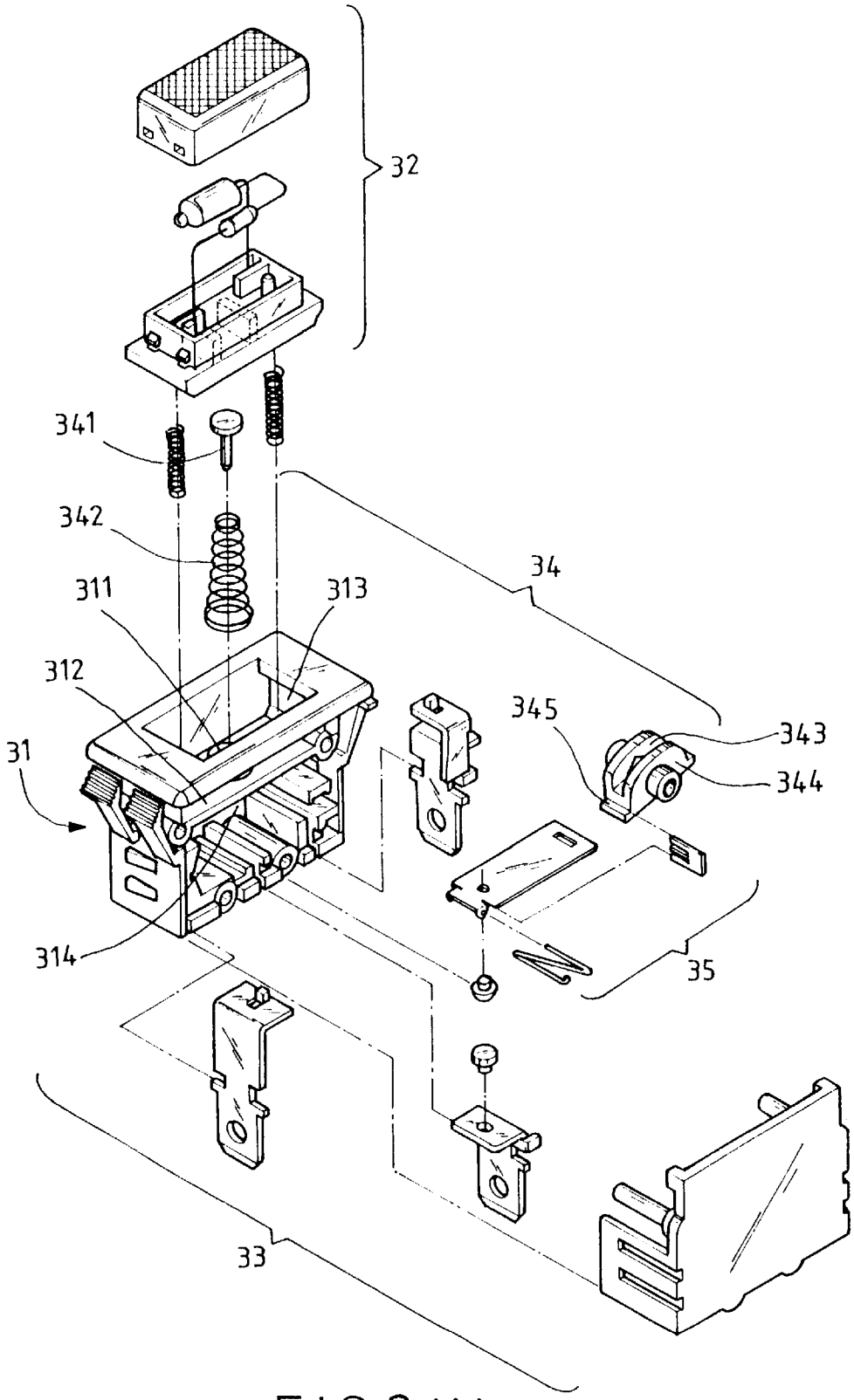
FIG. 3 (A) PRIOR ART
FIG. 3A is an exploded view of an overload protective press button switch according to Taiwan patent publication no. 458362.
FIG. 3B is a sectional assembly view of the overload protective press button switch shown in FIG. 3A.
FIG. 3C is similar to FIG. 3A but showing the press button depressed.
FIG. 3D shows the status of the overload protective press button switch after the action of FIG. 3C.
FIG. 3E shows the status of the overload protective press button switch when pressed again after the action of FIG. 3D.
Figure 3B:
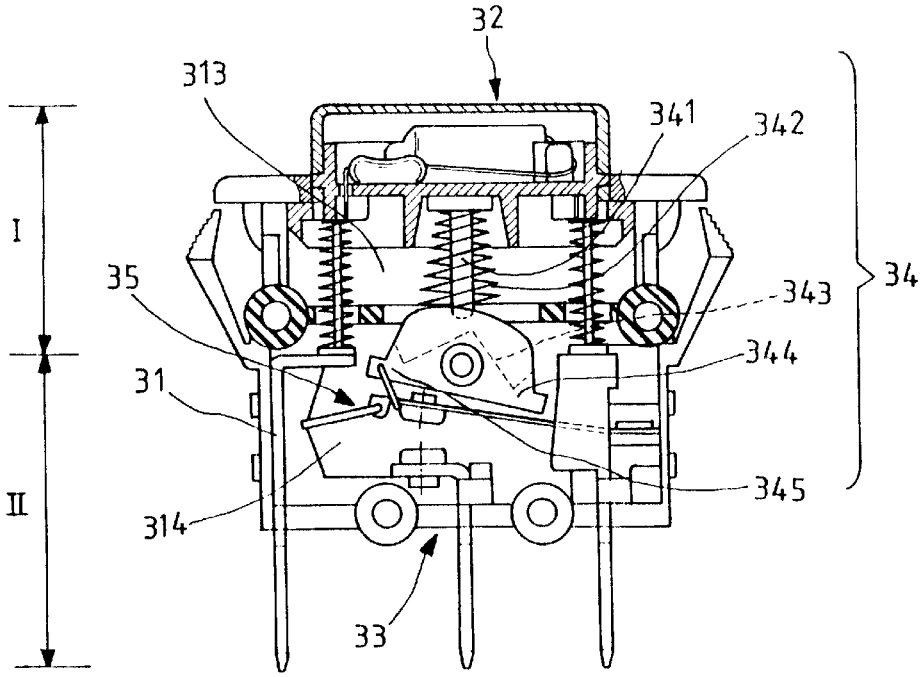
FIG. 3(B) PRIOR ART
Figure 3C:
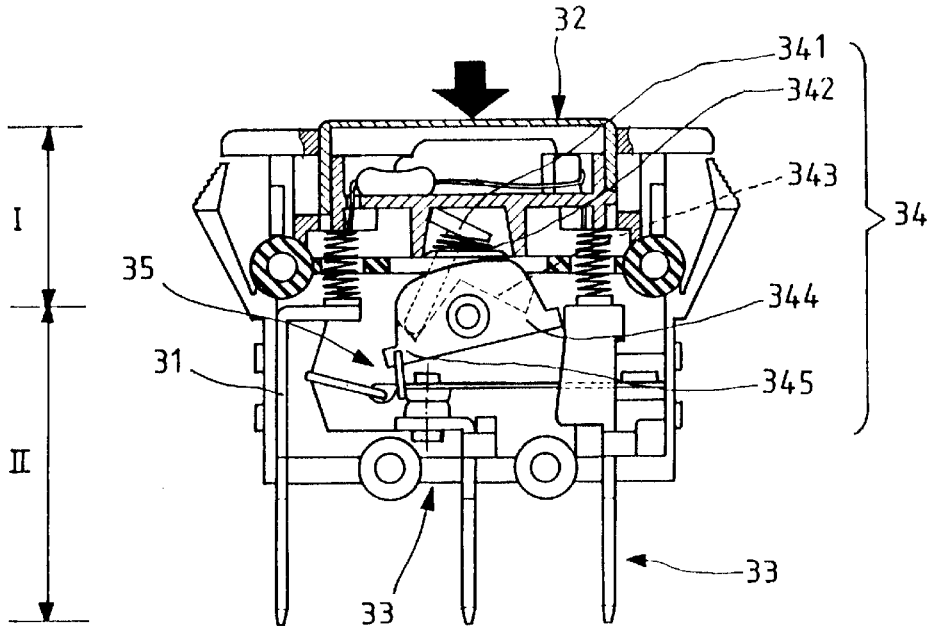
FIG. 3(C) PRIOR ART
Figure 3D:
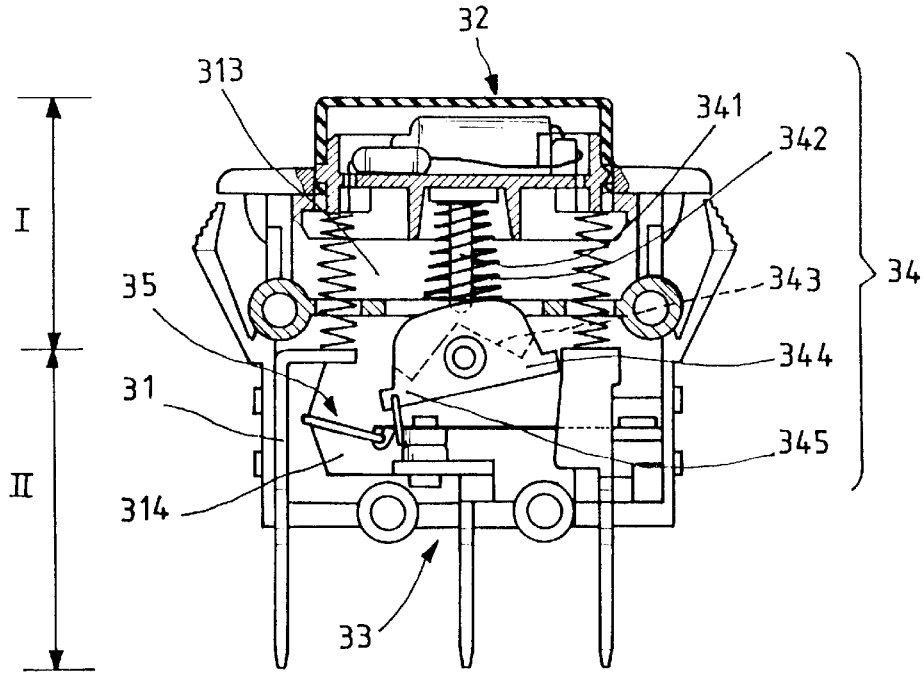
FIG. 3(D) PRIOR ART
Figure 3E:
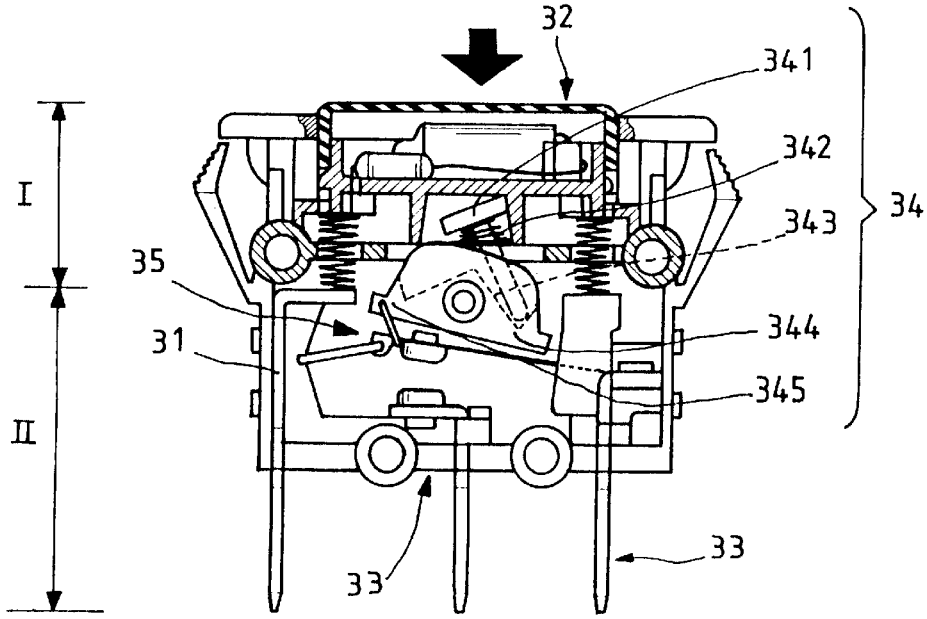
FIG. 3(E) PRIOR ART

Referring to FIGS. From 4 through 9, a press button switch is shown comprising a housing 4, a press button 5, terminals 6 (first terminal 6*a*, second terminal 6*b*, and third terminal 6*c*), a seesaw switching mechanism 7, and an actuating structure 8.

The housing 4 is a hollow member having a top opening 42, and a side cover 41 covered on one lateral open side thereof. The press button 5 is shaped like a rectangular cap having two pivot holes 52 aligned at two sides and vertically movably mounted in the top opening 42 of the housing 4 and supported on springs 51. The terminals 6 are mounted in the housing 4 at a bottom side. The seesaw switching mechanism 7 is installed in the housing 4, and controlled to switch on/off the circuit of the terminals 6. The actuating structure 8 is installed in the housing 4, and controlled by the press button 5 to move the seesaw switching mechanism 7 between on/off positions.

The actuating structure 8 comprises two sliding tracks 81 bilaterally provided inside the housing 4, a push member 82 (one of the endless sliding tracks 81 is formed in the inner side of the side cover 41), and a retaining structure 83. The push member 82 is a substantially Π-shaped member injection-molded from springy plastics and pivoted to the press button 5. The push member 82 comprises two horizontal pivot rods 823 respectively perpendicularly extended from two opposite vertical lateral sidewalls thereof near the top and respectively coupled to the pivot holes 52 of the press button 5, two bottom push portions 821 pressed on the seesaw switching mechanism 7, and two guide rods 822 respectively perpendicularly extended from the two opposite vertical lateral sidewalls adjacent the bottom push portions 821 and respectively slidably coupled to the sliding tracks 81 for moving along the sliding tracks 81 to guide the seesaw switching mechanism 7 between on/off positions. The retaining structure 83 comprises a hooked first stop device 831 fixedly provided at the top of the seesaw switching mechanism 7, and a second stop device 832 fixedly provided at the push member 82 (alternatively, the second stop device 832 can be provided at the press button 5). When the seesaw switching mechanism 7 tilted to a particular angle, the hooked first stop device 831 is stopped against the second stop device 832 to limit the tilting angle of the seesaw switching mechanism 7 and to stop the seesaw switching mechanism 7 in "on" position.

By means of the aforesaid arrangement, the press button 5 and the push member 82 form a linkage M adapted to control on/off position of the seesaw switching mechanism 7. When tripped off upon an overcurrent, the first stop device 831 is moved away from the linkage M, enabling the springs 51 to push the press button 5 back to the upper limit position, namely, the off position.

Figure 5:
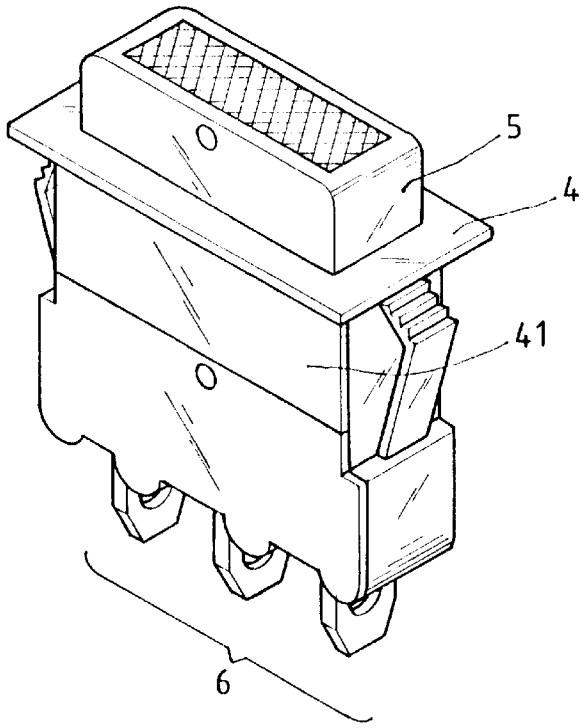
FIG. 5 is an elevational view of the present invention, showing the press button type safety switch switched off.
Figure 7:
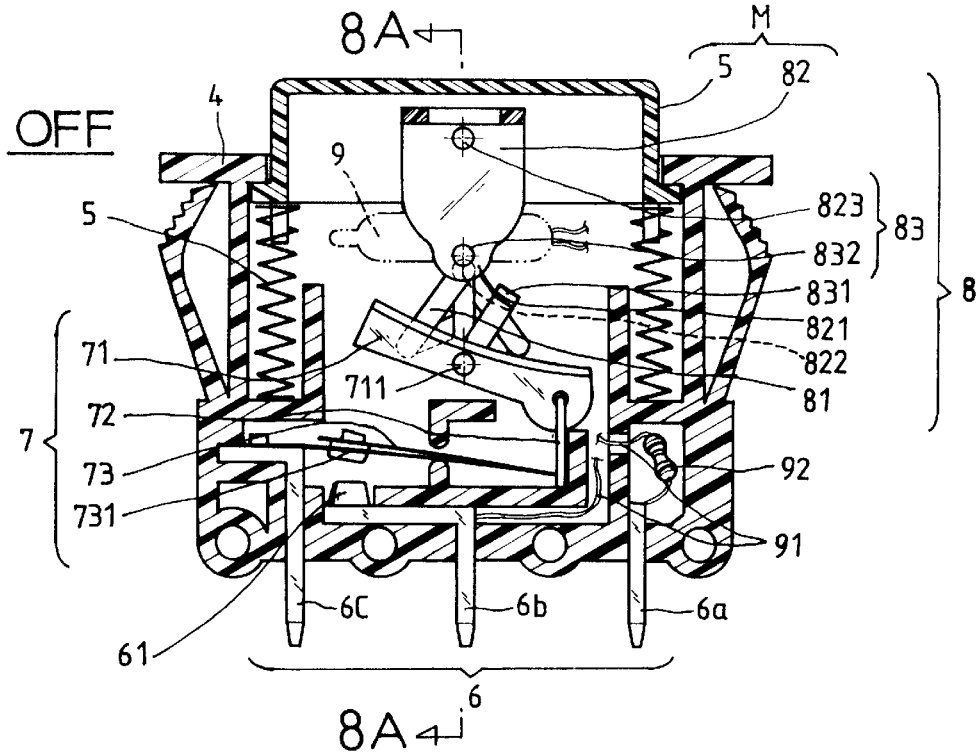
FIG. 7A is a sectional view of the present invention, showing the press button type safety switch switched off.
FIG. 7B is similar to FIG. 7A but showing the press button pressed.
FIG. 7C is a sectional view of the present invention, showing the press button switch maintained in "on" position after the action of FIG. 7B.
FIG. 7D is similar to FIG. 7C but showing the press button pressed.
FIG. 7E is a schematic drawing showing the seesaw switching mechanism tripped off upon an overcurrent.
Figure 7:
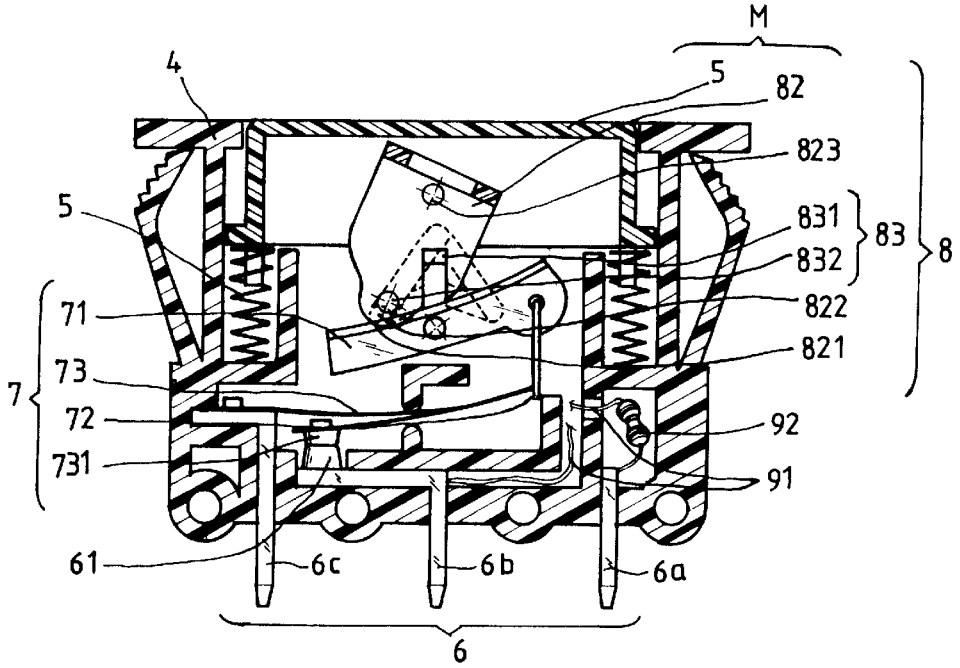

FIGS. 5 and 7A show the safety switch in "off" position. At this time, the press button 5 is kept in the upper limit position, and the plank 71 of the seesaw switching mechanism 7 is tilted rightwards to lower a link 72. 4 again, thereby causing the contact 731 of a conducting plate 73 of the seesaw switching mechanism 7 to be moved away from the contact 61 of the second terminal 6*b*. The conducting plate 73 of the seesaw switching mechanism 7 is a bimetal constructed according to the known techniques.

Figure 6:
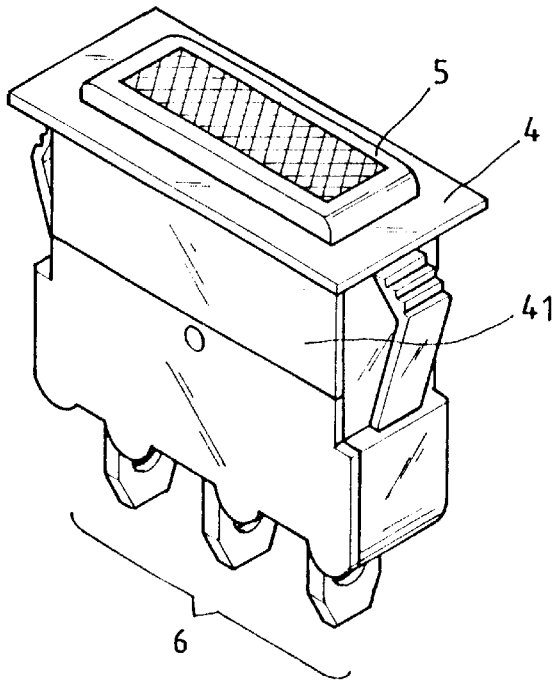
Figure 7C:
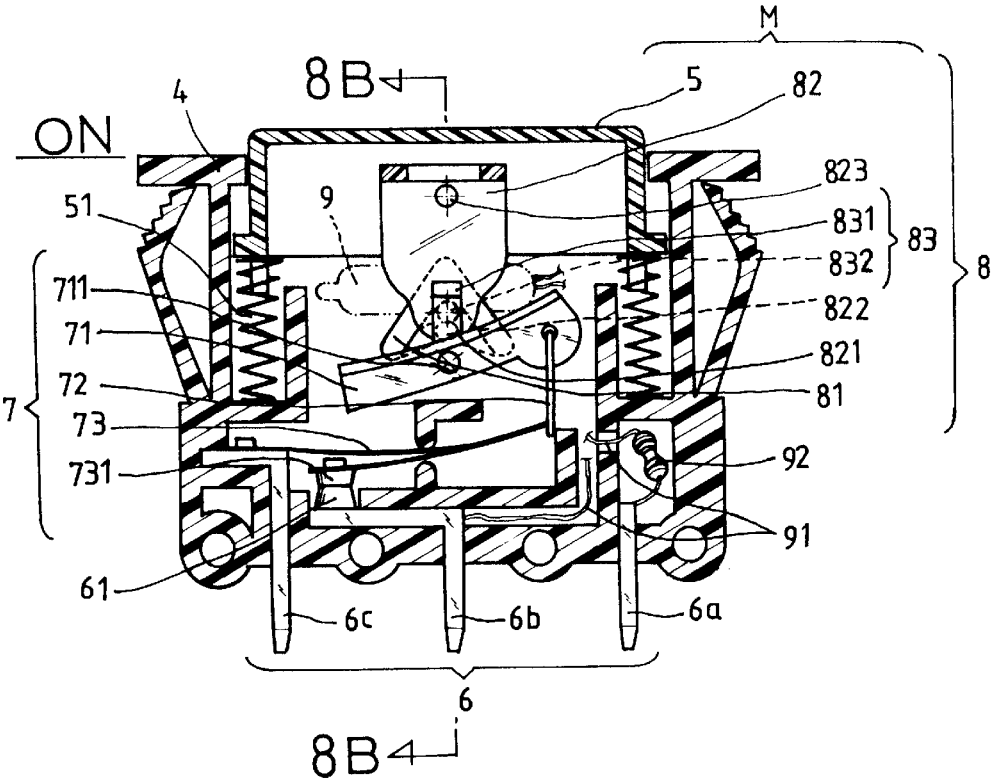

FIGS. 6 and 7C show the safety switch in "on" position. At this time, the press button 5 slightly protrudes over the top side of the housing 4, the plank 71 of the seesaw switching mechanism 7 is tilted leftwards to lift the link 72, thereby causing the contact 731 of the conducting plate 73 to be forced into contact of the contact 61 of the second terminal 6*b*. Because the inner end of the conducting plate 73 is fixedly fastened to the third terminal 6*c*, the circuit is maintained in "on" position at this time.

Further, a neo lamp 9 is connected to the first terminal 6*a* and 6*b*, and a resistor 92 is installed in one lead wire 91 of the neo lamp 9. When the safety switch switched on, the neo lamp 9 is turned on.

Figure 8:
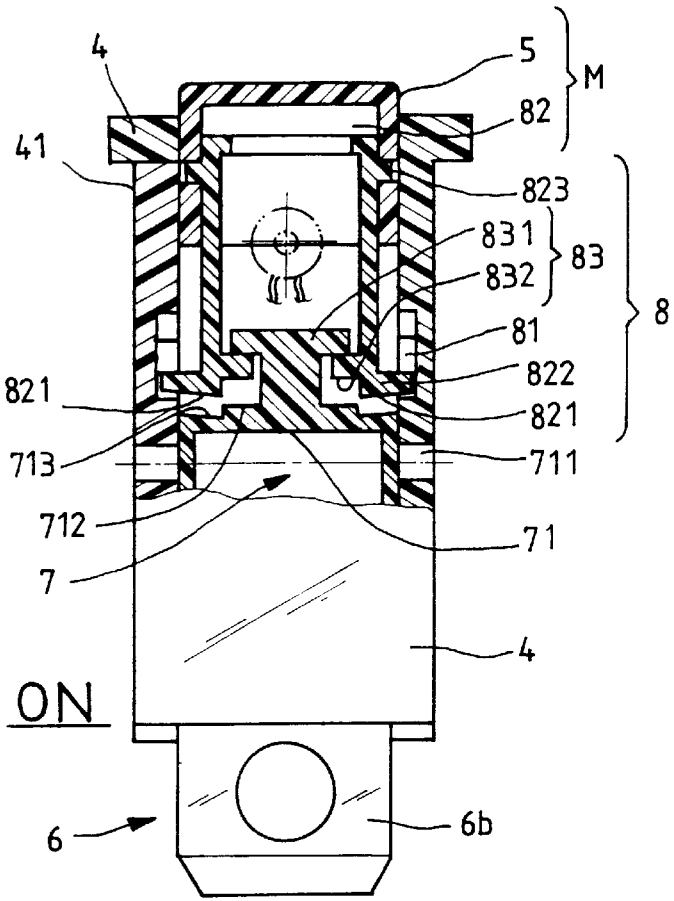
FIG. 8A is a sectional view, in an enlarged scale, taken along line 8A—8A of FIG. 7A.
FIG. 8B is a sectional view, in an enlarged scale, taken long line 8B—8B of FIG. 7C.
Figure 8:
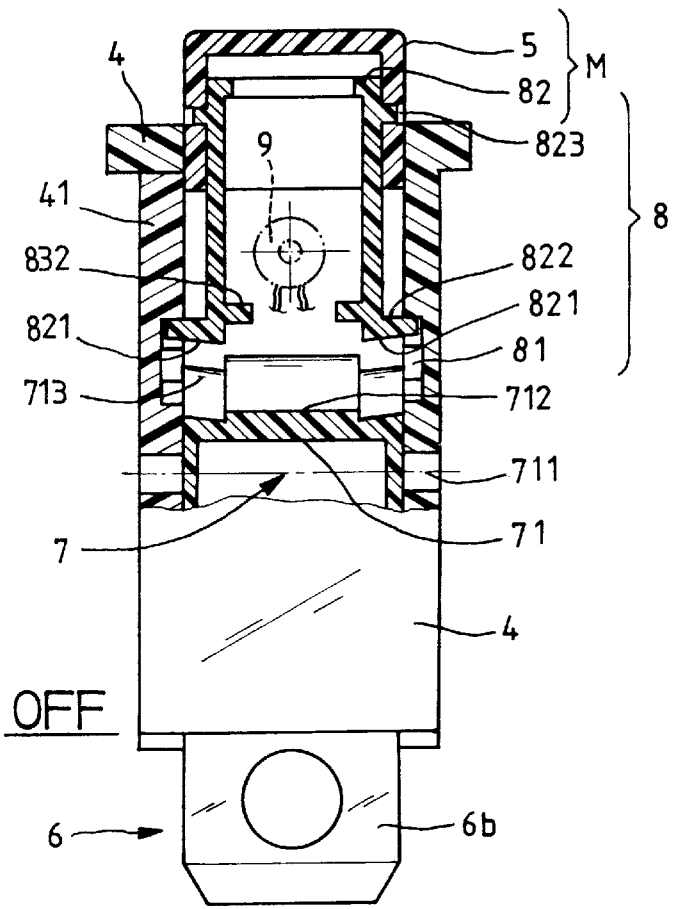

Referring to FIGS. 7C and 8B, when the safety switch switched on, the first stop device 831 of the retaining mechanism 83 is moved to the top side of the second stop device 832 to stop the push member 82 and the press button 5 from upward movement, keeping the press button 5 in "on" position. Therefore, the user can know the status of the safety switch from the outer appearance.

The aforesaid hooked first stop device can be shaped like a T-bar upwardly extended from the plank 71 of the seesaw switching mechanism 7. The second stop device 832 can be formed of two stub rods horizontally bilaterally provided inside the push member 82.

Figure 4:
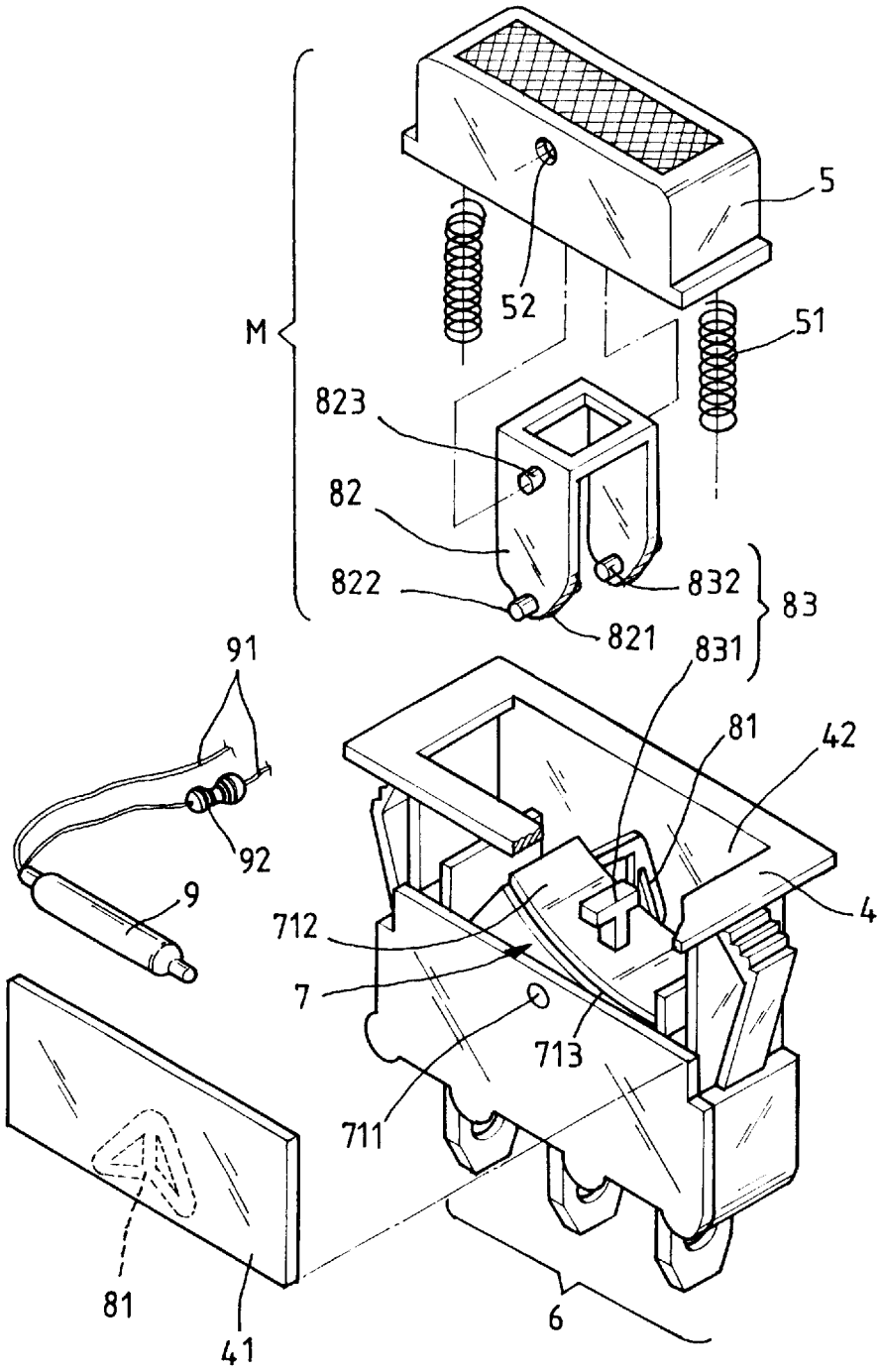
FIG. 4 is an exploded view of a press button type safety switch according to the present invention.

As illustrated in FIGS. 4, 8A and 8B, the plank 71 of the seesaw switching mechanism 7 has two pivot rods 711 respectively perpendicularly extended from two opposite lateral sidewalls thereof and respectively pivoted to the two opposite vertical lateral sidewalls of the housing 4. The top side of the plank 71 is smoothly curved inwards, having a protruded middle portion 712 and two elongated side bearing portions 713 respectively sloping toward the protruded middle portion 712 at a lower elevation than the protruded middle portion 712. When installed, the bottom push portions 821 of the push member 82 are respectively stopped at the side bearing portions 713 of the plank 71 of the seesaw switching mechanism 7. Because the side bearing portions 713 respectively sloping downwards toward the protruded middle portion 712, the push member 82 is maintained coupled to the plank 71 of the seesaw switching mechanism 7 for positive switching control. Further, the springy material property of the push member 82 keeps the guide rods 822 coupled to the sliding tracks 81 of the actuating structure 8.

Figure 9:
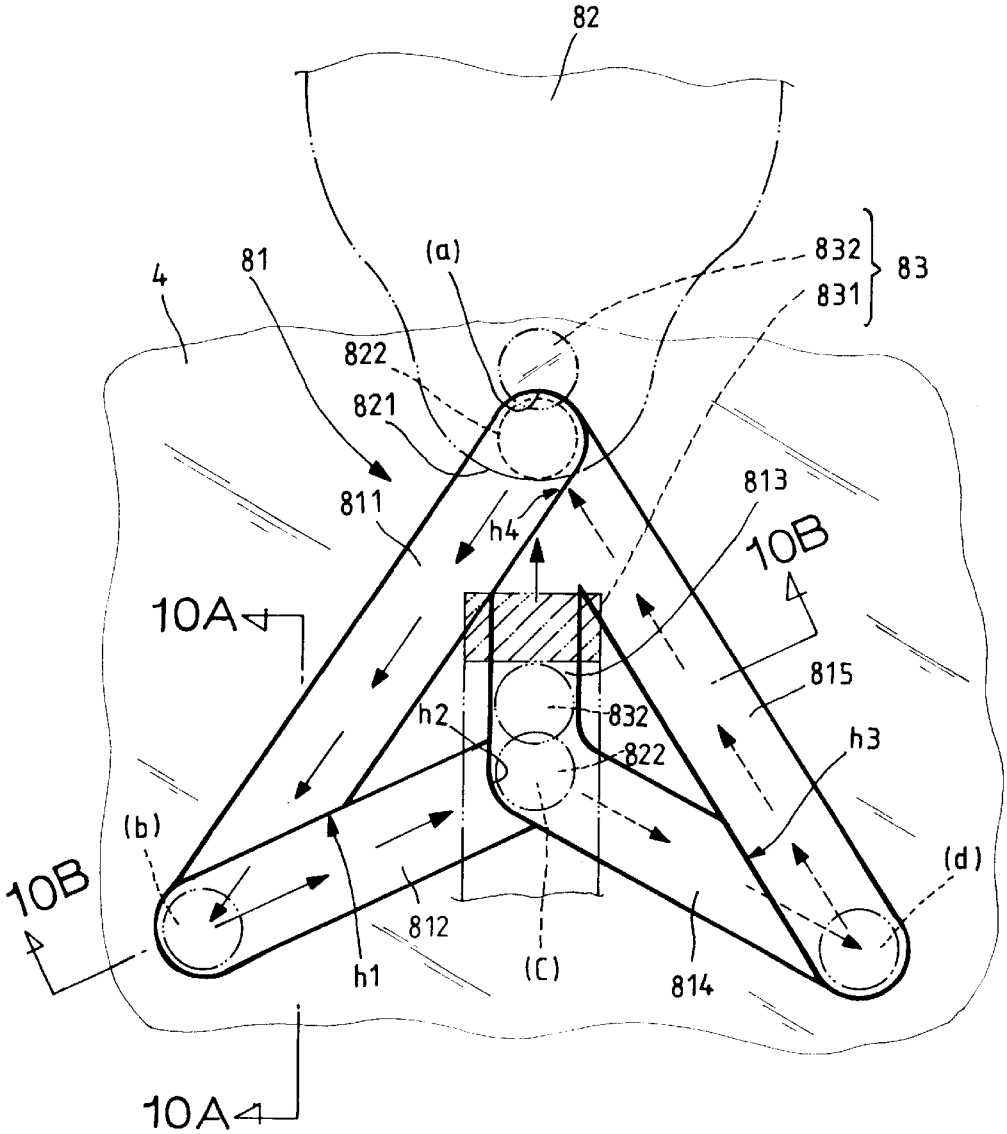
FIG. 9 is a schematic drawing showing the design of the sliding track according to the present invention.

Referring to FIG. 9, each sliding track 81 is formed of five sliding rails 811~815 connected to one another, forming a top positioning point "a" at the connecting area between the first sliding rail 811 and the fifth sliding rail 815, a bottom positioning point "c" at the connecting area between the second sliding rail 812 and the fourth sliding rail 814, a first turning point "b" at the connecting area between the first sliding rail 811 and the second sliding rail 812, and a second turning point "d" at the connecting point between the four sliding rail 814 and the fifth sliding rail 815. The third sliding rail 813 is connected between the top positioning point "a" and the bottom positioning point "c". The top positioning point "a" and the bottom positioning point c are vertically aligned and disposed above the elevation of the first turning point "b" and the second turning point "d". The first turning point "b" and the second turning point "d" are equally spaced from the bottom positioning point "d" at two sides. Therefore, the first sliding rail 811, the second sliding rail 812 and the third sliding rail 813 form a first sliding loop (see the solid arrowhead signs); the third sliding rail 813, the fourth sliding rail 814, and the fifth sliding rail 815 form a second sliding loop (see the imaginary arrowhead signs).

Figure 10A:
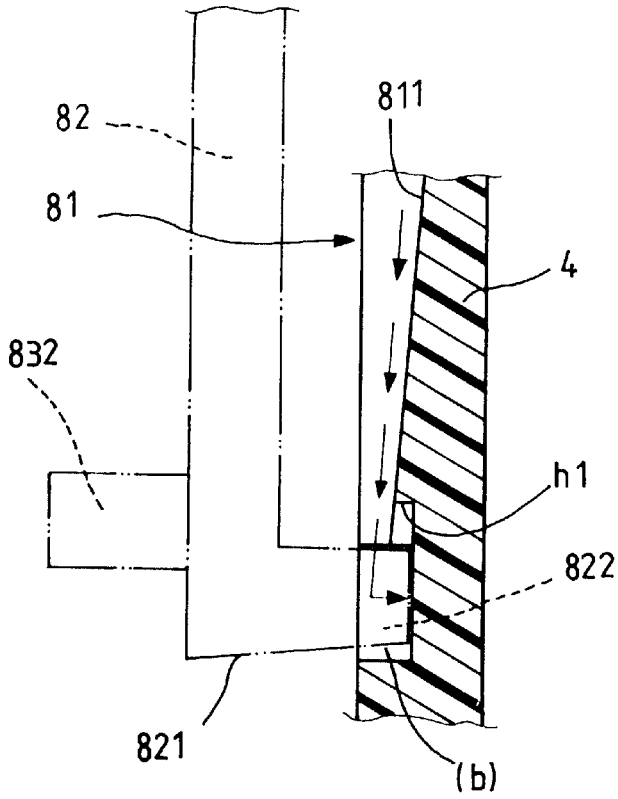
FIG. 10A is a sectional view taken along line 10A—10A of FIG. 9.
Figure 10B:
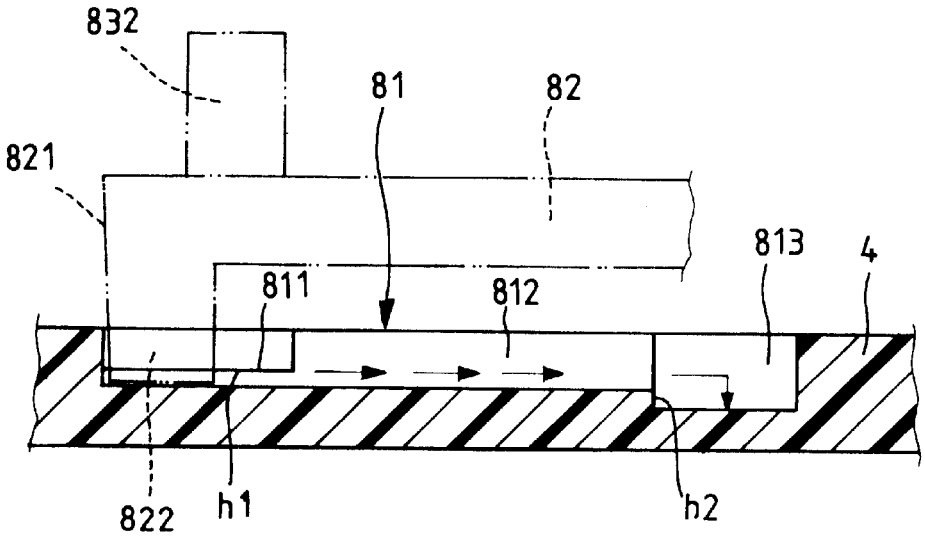
FIG. 10B is a sectional view taken along line 10B—10B of FIG. 9.

Referring to FIGS. 10A and 10B, there is an elevational difference h1 in the connecting area between the first sliding rail 811 and the second sliding rail 812, an elevational difference h2 in the connecting area between the second sliding rail 812 and the third sliding rail 813, an elevational difference h3 in the connecting area between the third sliding rail 813 and the first sliding rail 811, an elevational difference h4 in the connecting area between the fourth sliding rail 814 and the fifth sliding rail 815, and an elevational difference h3 (equal to the elevational difference h3 in the connecting area between the third sliding rail 813 and the first sliding rail 811) in the connecting area between the fifth sliding rail 815 and the first sliding rail 811.

Referring to FIGS. 7A and FIG. 9, when switched off, the press button 5, the guide rods 822 of the push member 82 are respectively positioned in the top positioning points "a" of the sliding tracks 81, and the press button 5 are supported in the upper limit position. When pushing the press button 5 downwards from the upper limit position shown in FIG. 7A to the elevation of the top side of the housing 4, i.e., the lower limit position shown in FIG. 7B, the guide rods 822 of the push member 8 are moved along the first sliding rail 811 to the first turning point "b". At this time, the bottom push portions 821 of the push member 82 forces the plank 71 to tilt and to turn the right end upwards. When the user released the hand from the press button 5 at this time, the springs 51 immediately push the press button 5 upwards, thereby causing the guide rods 822 to be moved upwards along the second sliding track 812 to the bottom positioning point "c". At this time, the first stop device 821 is disposed above the elevation of the third sliding rail 813 and hooked up with the second stop device 832 (see FIGS. 7C and 9), holding the press button 5 in "on" position. Because the press button 5 has only a small upper part protruding over the topside of the housing 4, the user can see "on" status of the safety switch from the outer appearance.

Figure 7D:
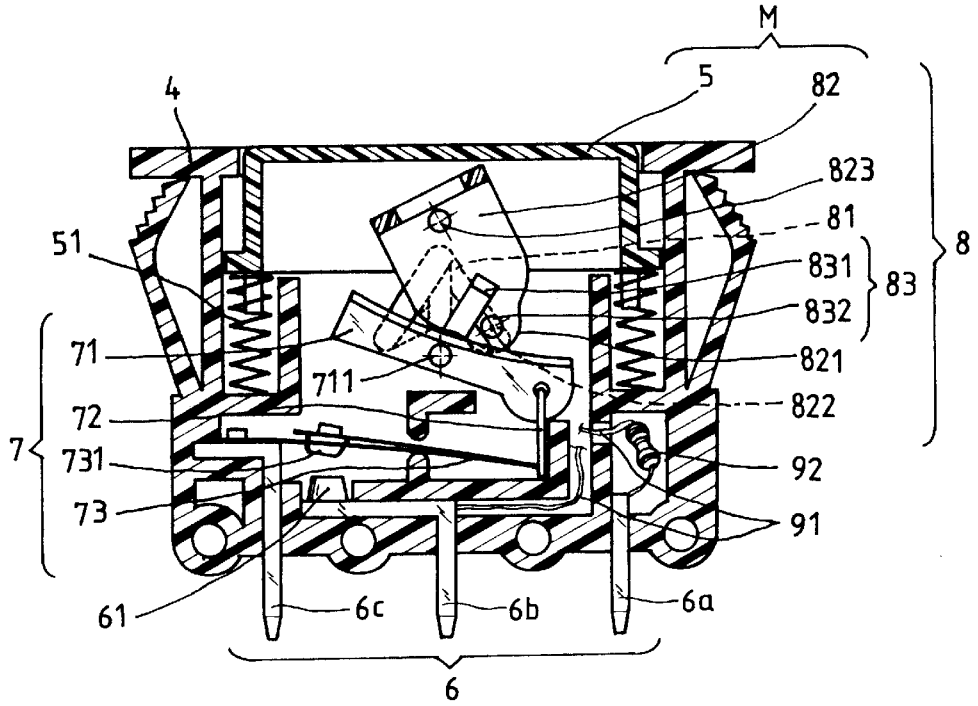

When wishing to switch off the switch, press the press button 5 to the lower limit position as shown in FIG. 7D. At this time, the guide rods 822 are moved along the third sliding rail 813 and the fourth sliding rail 814 to change the tilting direction of the plank 71 of the seesaw switching mechanism 7. When the push member 82 moved to the second turning point d (see FIG. 9), the link 72 is lowered to switch off the seesaw switching mechanism 7. When released the press button 5 at this time, the guide rods 822 are moved from the second turning point "d" along the fifth sliding rail 815 to the top positioning point "a" shown in FIGS. 7A and 5, keeping the switch in "off" position.

Figure 7E:
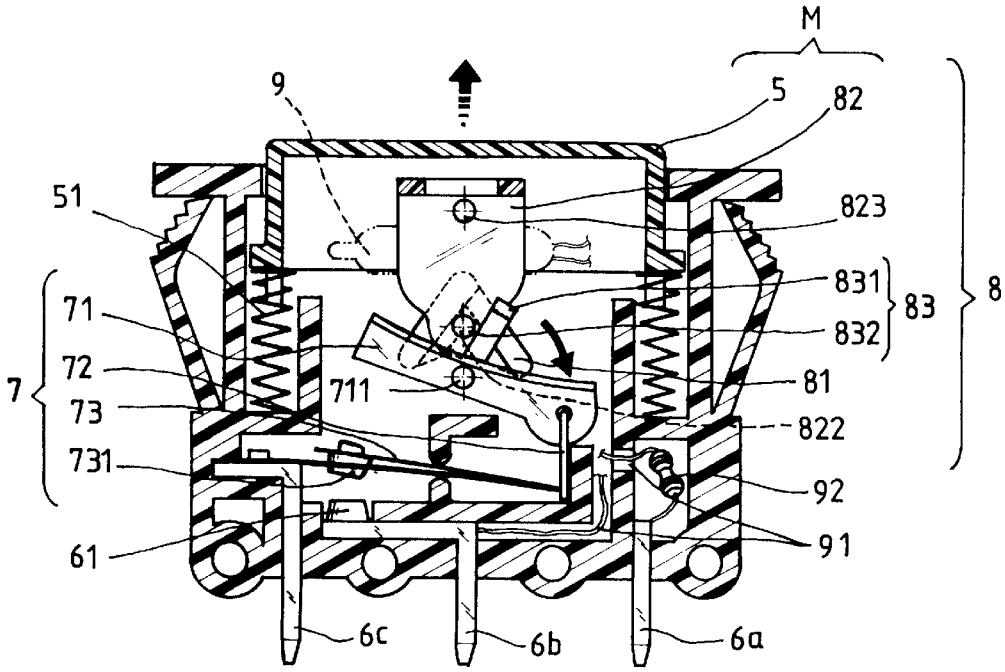

Referring to FIG. 7E, when an overcurrent occurred, the conducting plate 73 is deformed to force the link 72 downwards and to change the tilting angle of the plank 71. At this time, the first stop device 831 is disengaged from the second stop device 832, enabling the guide rods 822 to move from the bottom positioning point "c" shown in FIG. 9 upward to the top positioning point "a" shown in FIG. 7A, keeping the switch in "off" position.

Figure 11:
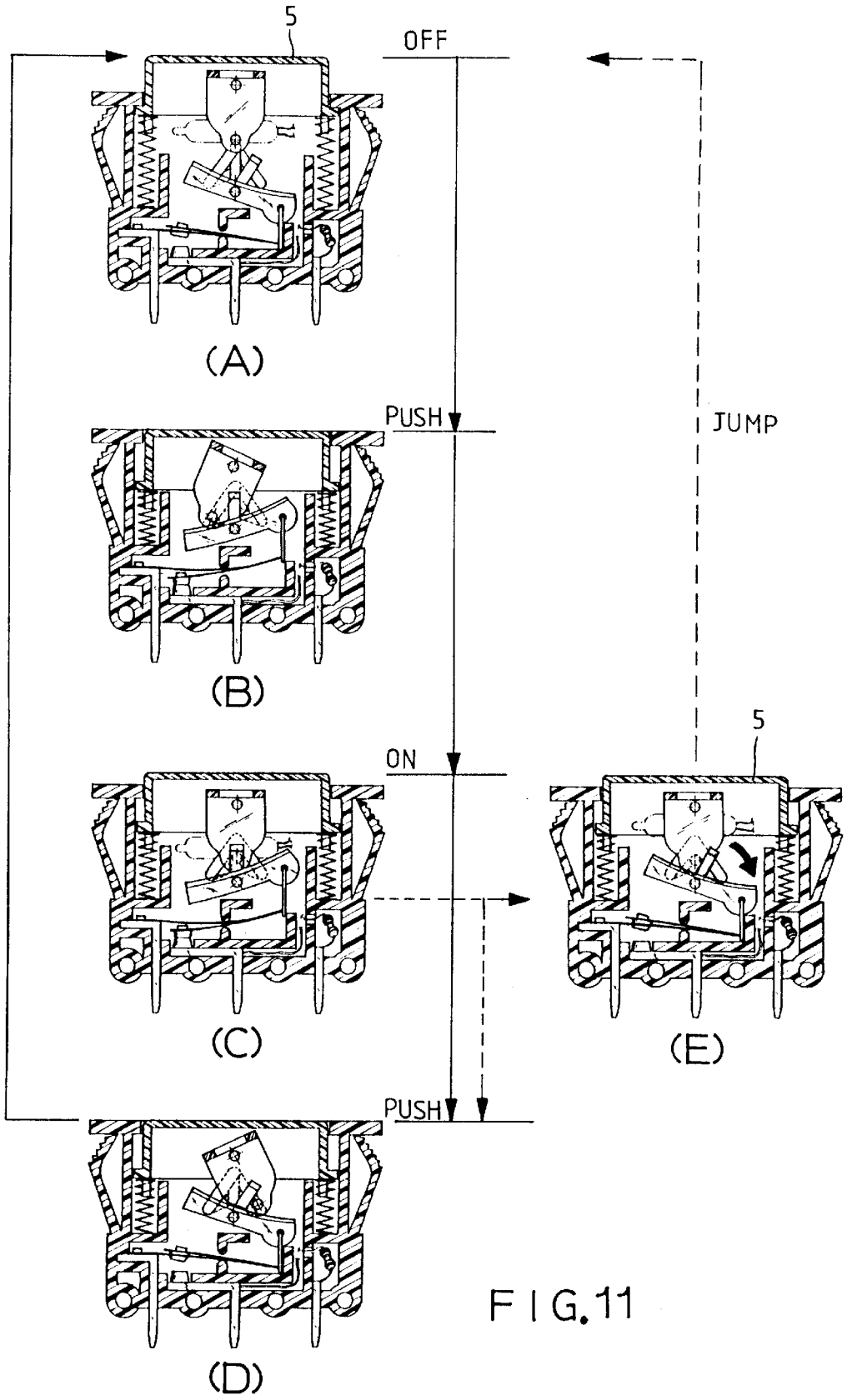
FIGS. 11(*a*)–(*e*) are a schematic drawing showing the continuous switching actions of the present invention.

As indicated above, the present invention has the advantages as follows:

1. The invention uses a push member 82 to match with two sliding tracks 81 inside the housing 4, achieving on/off control of the seesaw switching mechanism 7. The structure of the whole assembly of the safety switch is simple and durable in use. The installation of the neo lamp 9 does not occupy much space of the switch.
2. One can immediately know the on/off status of the safety switch simply by viewing the outer appearance of the switch. By means of the guidance of the sliding tracks 81, the linkage M of the press button 5 and push member 82 can positively be positioned in the top positioning point "a" or bottom positioning point "c". Further, the turning point "b" and the turning point "d" guide the push member 82 to change the tilting angle of the plank 71 positively.
3. The seesaw switching mechanism can be of any of a variety of seesaw switching devices having a plank for operation. When the switch switched off, he actuating structure 8 is disposed right above the center area of the plank 71 without affecting auto trip-off functioning of the seesaw switching mechanism 7. Therefore, the safety switch can be made in the form of a press button type overload protective safety switch.
4. As shown in the operation flow chart of FIG. 11 corresponding to FIGS. 7A~7E, the position of the press button 5 relative to the housing 4 tells on/off status of the switch. When tripped off, the jumps from (E) back to (A) again. Because the outer appearance and size of the invention meet specifications of regular switches, the safety switch of the present invention can be used to replace conventional switches, so as to improve the quality of safeness of home appliances or computers.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A press button type safety switch comprising:

a housing, said housing having a top opening;

spring means mounted inside said housing;

at least two terminals mounted in said housing for connecting to a power source;

a switching mechanism;

a press button mounted in the top opening of said housing and supported on said spring means for pressing by hand; and an actuating structure controlled by said press button to switch said switching mechanism between on and off positions;

wherein:

said actuating structure including two sliding tracks respectively formed of a plurality of sliding rails and arranged in parallel, and a push member pivoted to said press button at a bottom side and forming with said press button a linkage, said push member comprising two bottom push portions respectively supported on said switching mechanism for synchronous movement with said push member to move said switching mechanism between said on and off positions, two guide rods extended from two opposite lateral sides thereof and respectively slidably coupled to said sliding tracks for guiding movement of said push member to switch said switching mechanism between said on and off positions, and a stop device provided on an inside above said bottom push portions;

said switching mechanism including a plank disposed in contact with said bottom push portions of said push member for switching said at least two terminals between said on and off positions, an overcurrent protective conducting plate for automatically tripping off the circuit of said terminals upon an overcurrent, and a stop device upwardly extended from said plank for hooking up with the stop device of said push member when said switching mechanism is switched on, said plank being linked to said overcurrent protective conducting plate and forcible by said overcurrent protective conducting plate to change a tilting angle and to disengage said stop device from the stop device of said push member for enabling said press button to be pushed upwards by said spring means when said overcurrent protective conducting plate is tripped off upon an overcurrent.

2. The press button type safety switch as claimed in claim 1, wherein said sliding tracks are bilaterally provided inside said housing.

3. The press button type safety switch as claimed in claim 1 wherein said housing has a side cover covered on one lateral open side thereof, and sliding tracks are respectively formed in said side cover of said housing and one lateral sidewall of said housing opposite to said side cover.

4. The press button type safety switch as claimed in claim 1, wherein said sliding tracks of said actuating structure each are formed of a first sliding rail, said first sliding rail having a first end and a second end, a second sliding rail, said second sliding rail having a first end and a second end, the first end of said second sliding rail being connected to the second end of said first sliding rail and forming with the second end of said first sliding rail a first turning point, a third sliding rail, said third sliding rail having a first end connected to the second end of said second sliding rail and forming with the second end of said second sliding rail a bottom positioning point and a second end connected to the first end of said first sliding rail and forming with the first end of said first sliding rail a top positioning point, a fourth sliding rail, said fourth sliding rail having a first end connected to said bottom positioning point and a second end, a fifth sliding rail, said fifth sliding rail having a first end connected to the second end of said fourth sliding rail and forming with the second end of said fourth sliding rail a second turning point and a second end connected to said top positioning point, said first sliding rail, said second sliding rail and said third sliding rail forming a first sliding loop, said third sliding rail, said fourth sliding rail and said fifth sliding rail forming a second sliding loop.

5. The press button type safety switch as claimed in claim 4, wherein there is an elevational difference in the connecting area between said first sliding rail and said second sliding rail, an elevational difference between said second sliding rail and said third sliding rail, an elevational difference between said third sliding rail and said first sliding rail, an elevational difference between said fourth sliding rail and said fifth sliding rail, and an elevational difference between said fifth sliding rail and said first sliding rail, the elevational difference between said fifth sliding rail and said first sliding rail being equal to the elevational difference between said first sliding rail and said third sliding rail.

6. The press button type safety switch as claimed in claim 5, wherein the stop device of said switching mechanism is a T-shaped member fixedly provided at a top side of the plank of said switching mechanism corresponding to the stop device of said push member.

7. The press button type safety switch as claimed in claim 5, wherein said overcurrent protective conducting plate has a fixed end fixedly connected to one of said terminals and a free end linked to one end of said plank of said switching mechanism and for contacting a second terminal of said terminals.

8. The press button type safety switch as claimed in claim 1, wherein said push member comprises two pivot rods horizontally extended from two opposite vertical sidewalls thereof; said press button comprises two pivot holes respectively disposed in two opposite vertical lateral sidewalls thereof and respectively coupled to the pivot rods of said push member.

9. The press button type safety switch as claimed in claim 1, wherein said switching mechanism comprises a plank controlled by said push member to selectively switch on and off the circuit of said terminals, said plank having two pivot rods disposed at two opposite lateral sides and respectively pivoted to a respective pivot hole in said housing.

10. The press button type safety switch as claimed in claim 9, wherein the free end of said overcurrent protective conducting plate is linked to said plank of said switching mechanism by a link.

* * * * *